US007021037B1

(12) United States Patent
Szymas

(10) Patent No.: US 7,021,037 B1
(45) Date of Patent: Apr. 4, 2006

(54) ADAPTIVE SADDLE WITH SUPPORT ASSEMBLY

(76) Inventor: Karen M. Szymas, 13301 120th Ave., Grand Haven, MI (US) 49417

( * ) Notice: Subject to any disclaimer, the term of this patent is extended or adjusted under 35 U.S.C. 154(b) by 0 days.

(21) Appl. No.: 10/719,391

(22) Filed: Nov. 21, 2003

Related U.S. Application Data

(60) Provisional application No. 60/428,040, filed on Nov. 21, 2002.

(51) Int. Cl.
*B68C 1/02* (2006.01)

(52) U.S. Cl. ..... 54/44.1

(58) Field of Classification Search ..... 54/44.1, 54/44.2, 44.3, 46.2; 297/195.1, 195.11, 411.32, 297/411.36
See application file for complete search history.

(56) References Cited

U.S. PATENT DOCUMENTS

| | | | | |
|---|---|---|---|---|
| 1,214,364 | A * | 1/1917 | Peterson | 54/44.2 |
| 3,894,601 | A * | 7/1975 | Gestring | 180/214 |
| 4,033,097 | A | 7/1977 | Petit | |
| 4,607,882 | A * | 8/1986 | Opsvik | 297/195.11 |
| 5,029,434 | A | 7/1991 | Erickson | |
| 5,284,005 | A | 2/1994 | Jacobi | |
| 5,383,327 | A * | 1/1995 | Dohln | 54/44.1 |
| 5,556,120 | A * | 9/1996 | Davis | 280/304.1 |
| 5,685,133 | A | 11/1997 | Travis | |
| 6,378,278 | B1 | 4/2002 | Talbot | |
| 6,619,747 | B1 * | 9/2003 | Ko et al. | 297/423.12 |
| 2002/0158492 | A1 * | 10/2002 | Ko et al. | 297/112 |

FOREIGN PATENT DOCUMENTS

FR 2788264 A1 * 7/2000

OTHER PUBLICATIONS

Hulce, Amanda, "Saddle Opening New World", Jul. 20, 2002, 4 pages, *The Holland Sentinel Online*.

* cited by examiner

*Primary Examiner*—Michael J. Carone
*Assistant Examiner*—Bret Hayes
(74) *Attorney, Agent, or Firm*—Butzel Long

(57) ABSTRACT

An adaptive saddle and support assembly for use with handicapped, disabled, or injured riders includes a saddle body having a front attachment point and a rear attachment point. The attachment points each can releasably receive a support assembly therein including a vertical support member to which can be attached a torso pad, a pair of forearm pads and a pair of handgrips depending on the needs of the rider.

13 Claims, 3 Drawing Sheets

ADAPTIVE SADDLE WITH SUPPORT ASSEMBLY

CROSS-REFERENCE TO RELATED APPLICATION

This application claims the benefit of U.S. Provisional Patent Application Ser. No. 60/428,040 filed Nov. 21, 2002.

BACKGROUND OF THE INVENTION

The present invention relates generally to horse saddles and in particular to an adaptive saddle and support assembly for use with handicapped, disabled, and injured riders.

The therapeutic benefits of horseback riding to those in the population who are handicapped, disabled or injured are well known. Saddles for use with handicapped, disabled, and injured riders are also well known. Some horse stables and trainers specialize in the physical training and therapy of handicapped, disabled, and injured riders. Many saddles, however, are designed only for quadriplegic riders, while other saddles are designed only for paraplegic riders, and still other saddles are designed only for riders with slight trunk control, etc. In addition, many of these saddles may not be used with riders of varied disabilities or may not be used so without great difficulty. Often only a single horse or a small group of horses at a stable has the correct temperament for carrying disabled riders. If the single horse or group of horses is used with many riders of varied disabilities, the various saddles must be disadvantageously changed each time a rider having a different disability is changed. In addition, it is expensive to purchase and maintain the numerous types of support saddles and the like on hand.

It is desirable, therefore, to provide a saddle and support assembly that may be adapted for use with riders of varied disabilities.

SUMMARY OF THE INVENTION

The present invention concerns an adaptive saddle and support assembly for use with handicapped, disabled, and injured riders. The adaptive saddle and support assembly includes a saddle body having a first attachment point and a second attachment point. The attachment points are adapted to selectively receive a support therein. The support includes a vertical support member that can receive a trunk support, a headrest, arm support members, forearm support members, handles and/or hip support members, depending on the needs of the rider.

The adaptive saddle and support assembly in accordance with the present invention is extremely versatile and may be adapted to be used for a number of riders of varying sizes, handicaps or injuries. The adaptive saddle and support assembly advantageously provides disabled, handicapped, and injured riders a large measure of independence and self-satisfaction in addition to the therapeutic benefits of physical activity. The adaptive saddle and support assembly allows a number of riders of varying disabilities the ability to ride a horse and take advantage of these known therapeutic benefits. Prior to the use of the adaptive saddle, each rider is evaluated to determine the need and placement of the support assembly on the saddle body.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
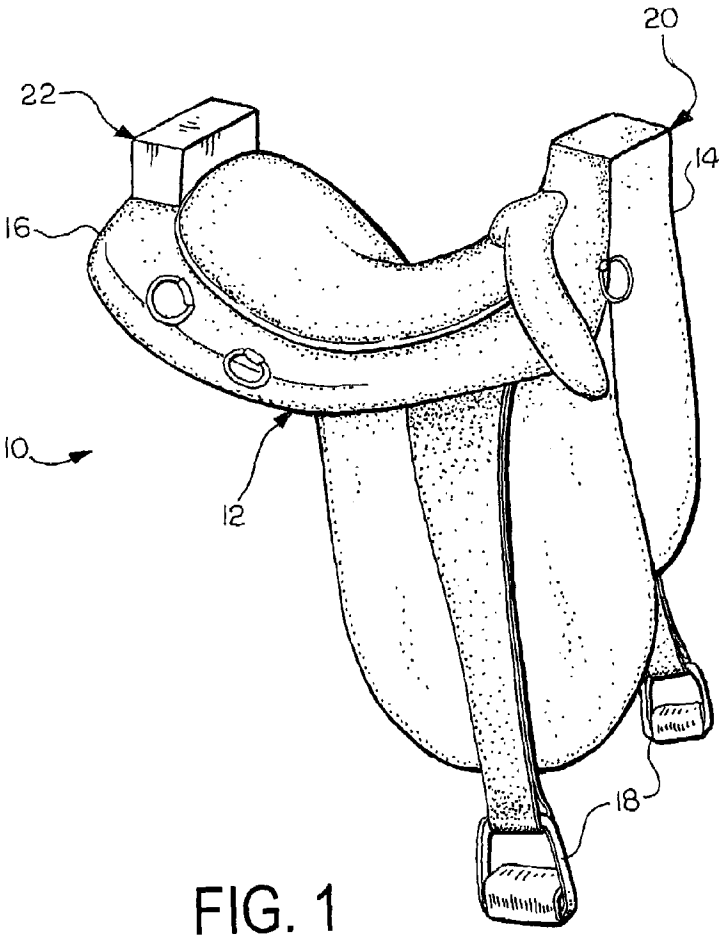
FIG. 1 is a perspective view of a saddle body in accordance with the present invention.

Referring now to FIG. 1, an adaptive saddle for use with handicapped, disabled, and injured riders in accordance with the present invention is indicated generally at 10. The adaptive saddle 10 includes a saddle body 12 having a pommel 14 at a front portion of the saddle body 12, a cantle 16 at a rear portion of the saddle body 12, and a pair of stirrups 18 (only one can be seen) extending downwardly from the saddle body 12. The saddle 10 is preferably a modified commercially available conventional horse saddle or the like. Adjacent the pommel 14 is mounted a first or front attachment point 20 and adjacent the cantle 16 is mounted a second or rear attachment point 22.

Figure 2:
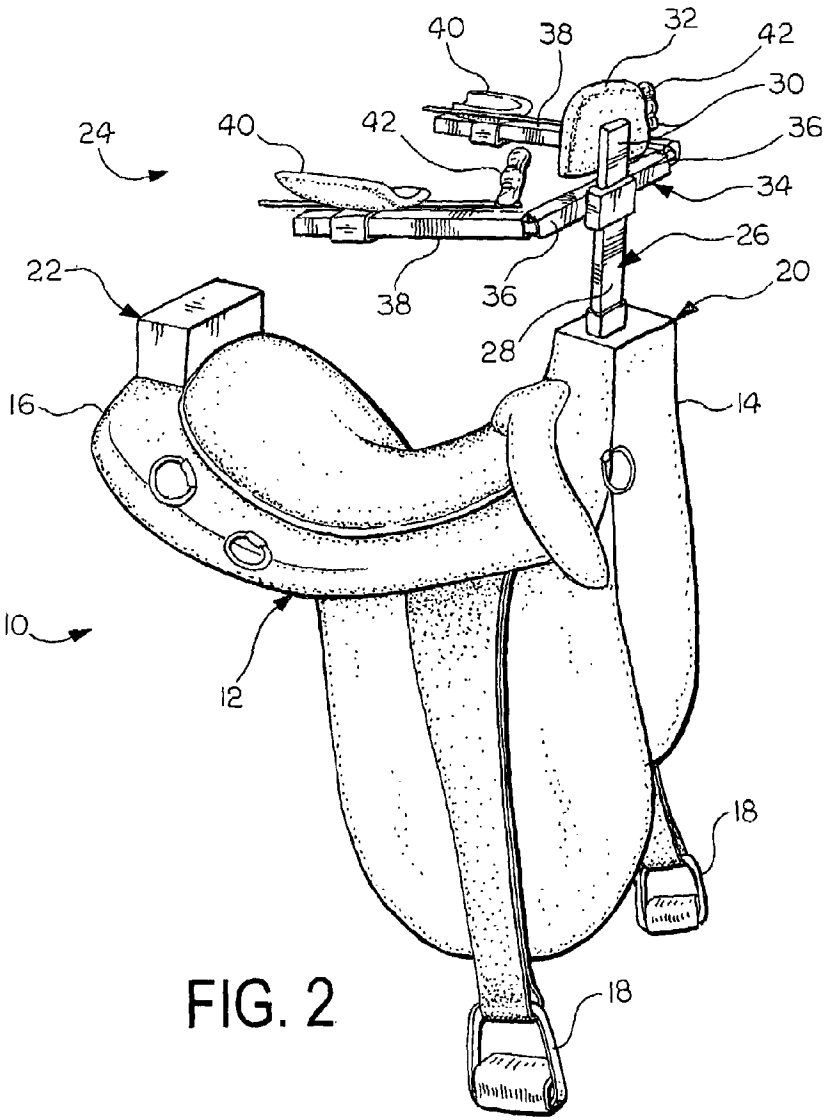
FIG. 2 is a perspective view of a support assembly in accordance with the present invention mounted at a front of the saddle body of FIG. 1.

Referring now to FIG. 2, a support assembly is indicated generally at 24 mounted at the front attachment point 20. The support assembly 24 is adapted to be selectively and releasably attached to either of the attachment points 20 and 22 on the saddle body 12 to form the adaptive saddle and support assembly 10. The support assembly 24 includes a generally vertical support member 26 that is releasably attached to the first attachment point 20 of the saddle body 12 at a first or lower end 28 thereof. The support member 26 can be constructed of steel or a material having similar material strength. Preferably, the support member 26 is tubular in construction to provide material strength but reduce the weight of the support member 26. A trunk pad 32 is removably and adjustably attached adjacent to a second or upper end 30 of the support member 26. A transverse frame member 34 having opposed ends 36 is removably attached perpendicular to the support member 26 intermediate the first end 28 and the second end 30. The trunk pad 32 and the frame member 34 can be advantageously moved along the length of the support member 26 to accommodate riders (not shown) of varying heights. An arm member 38 is releasably attached to, extends forwardly from and may rotate upwardly or outwardly from each end 36 of the frame member 34. Each arm member 38 can include a forearm pad 40 releasably and rotatably attached thereto. The forearm pads 40 may be advantageously rotated 360° about a longitudinal axis of the respective arm member 38, depending on the needs of the rider. The forearm pad 40 includes a handgrip assembly 42 adjustably and releasably attached thereto and extending outwardly therefrom. Alternatively, the handgrip assembly 42 is adjustably and releasably attached to a respective free end of the arm member 38 without the use of the forearm pad 40.

Figure 3:
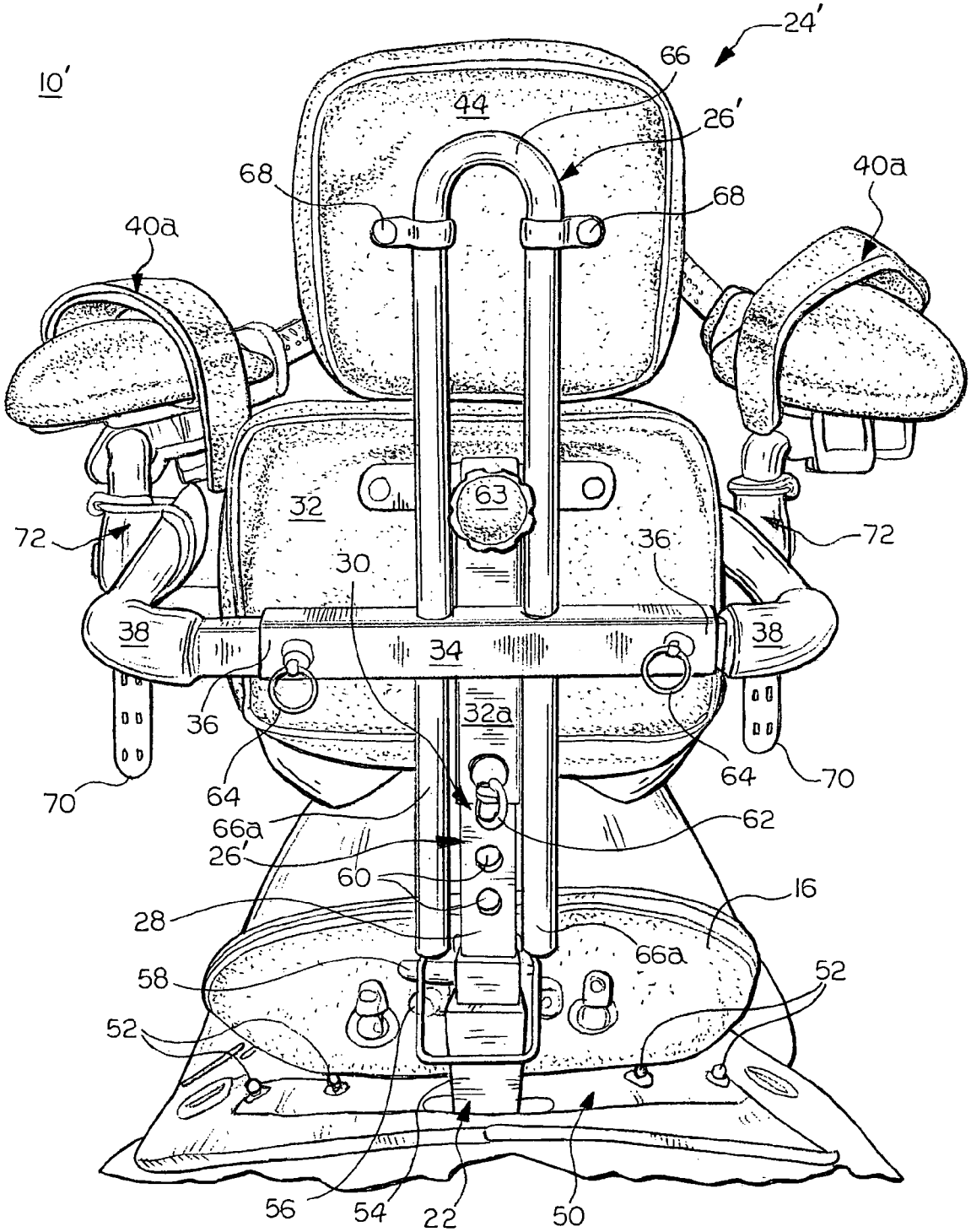
FIG. 3 is a fragmentary rear elevation view of an alternative embodiment of a support assembly in accordance with the present invention mounted at a rear of the saddle body of FIG. 1.
Figure 4:
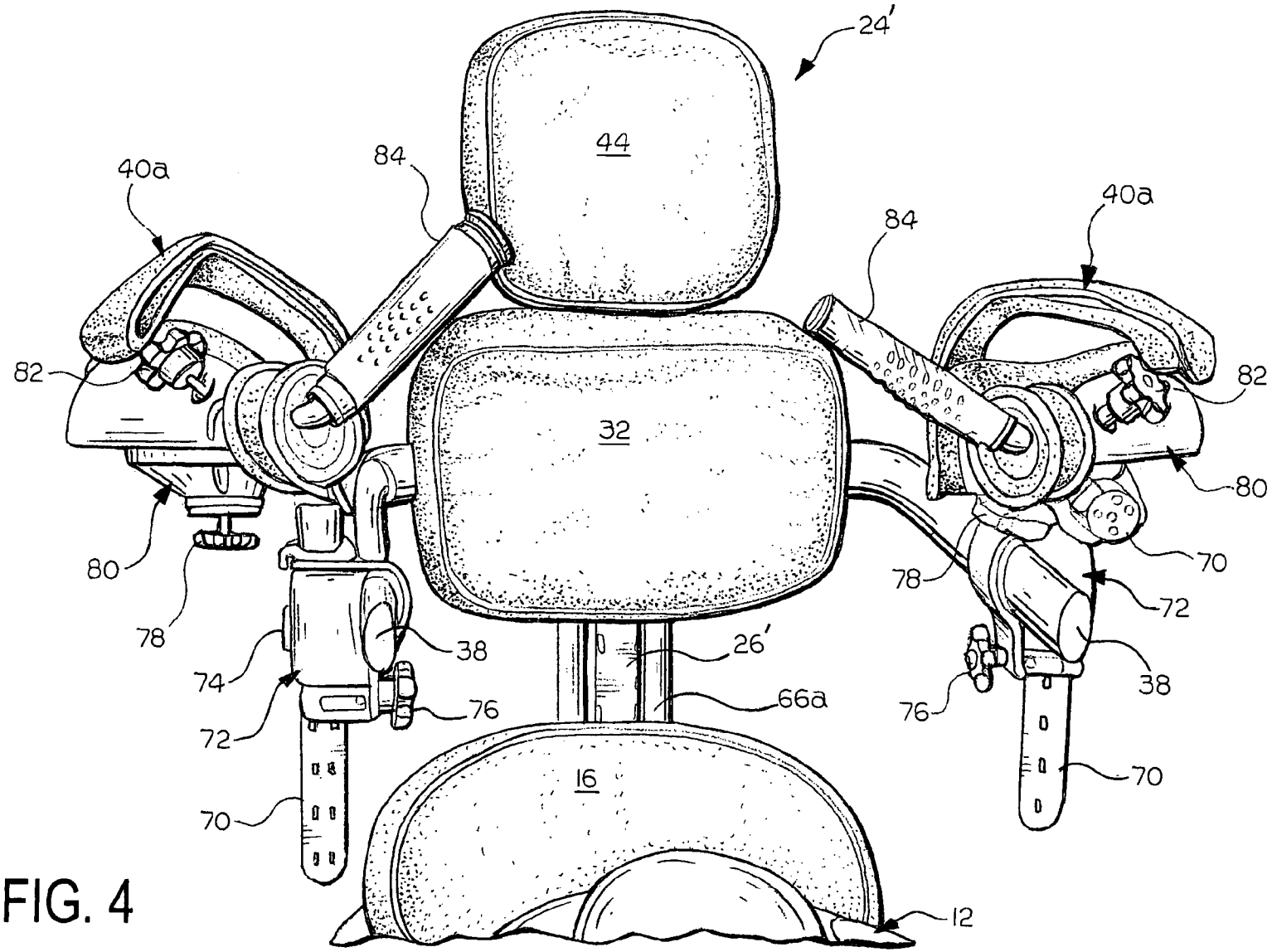
FIG. 4 is a fragmentary front elevation view of the support assembly and saddle body of FIG. 3.

FIGS. 3 and 4 show an alternate embodiment adaptive saddle 10' including a headrest member 44 removably and adjustably attached to the second end 30 of the support member 26'. The headrest member 44 can be advantageously moved upwardly and downwardly along the length of the support member 26' and the forearm pad 40 can be advantageously moved along the length of the arm member 38 when determining the need and placement of the support 24' on the saddle body 12 for each rider.

Referring now to FIG. 3, a rear view of the alternative embodiment of the adaptive saddle 10' is shown. The rear attachment point 22 preferably includes a base portion 50 attached to the saddle body 12 by a plurality of fasteners 52. An attachment portion 54 extends upwardly from the base portion 50 and includes an open upper end for receiving the first or lower end 28 of the support member 26'. The attachment portion 54 is attached to the cantle 16 by a plurality of fasteners 56. Preferably, the first end 28 of the support member 26' includes a plurality of spaced apart transverse bores (not shown) extending through opposing sides thereof for selectively receiving a pin 58. The transverse holes and the pin 58 permit the height of the support member 26' to be adjusted when determining the need and placement of the support assembly 24' on the saddle body 12 for each rider. The first attachment point 20 is preferably similar in construction to the second attachment point 22 shown in FIG. 3.

The support member 26' also preferably includes a plurality of spaced apart transverse bores 60 extending front to back therethrough. A spring-biased pin 62 extends through a lower portion of an attachment member 32*a* of the trunk pad 32. The pin 62 cooperates with the bores 60 to allow the trunk pad 32 to be adjusted vertically when determining the need and placement of the support 24' on the saddle body 12 for each rider. An upper end of the attachment member 32*a* includes a handwheel 63 attached thereto, discussed in more detail below.

The opposed ends 36 of the frame member 34 each preferably include a spring biased pin 64 disposed therein that cooperate with spaced apart longitudinal bores (not shown) extending through the ends of the arm members 38 that cooperate with the opposed ends of the frame member 34. The pins 64 cooperate with the bores in the arm members 38 to allow the arm members 38 to be adjusted inwardly and outwardly with respect to the trunk pad 32 when determining the need and placement of the support assembly 24' on the saddle body 12 for each rider.

The support member 26' is formed as an elongated U-shaped support bar 66 having an upper portion attached to a rear portion of the headrest 44 by a plurality of fasteners 68 and including a pair of legs 66*a* extending downwardly from the upper portion. The legs 66*a* of the support bar 66 are disposed between a rear surface of the trunk pad 32 and a forward surface of the frame member 34. Preferably, the legs 66*a* of the support bar 66 are releasably secured to the rear surface of the trunk pad 32 by a flange (not shown) that cooperates with an interior surface (not shown) of the handwheel 63. Turning the handwheel 63 clockwise secures the legs 66*a* between the respective opposing surfaces of the flange and the trunk pad 32. When the handwheel 63 is in an unsecured position, the legs 66*a* slide between the opposing surfaces of the flange and the trunk pad 32 such that the headrest 44 may be adjusted vertically with respect to the trunk pad 32. In order to remove the headrest 44, the handwheel 63 is turned counterclockwise and the headrest 44 and support bar 66 are removed from the trunk pad 32.

Referring now to FIG. 4, a front view of the assembled adaptive saddle 10' is shown having a pair of forearm pad assemblies 40*a*. Each of the forearm pad assemblies 40*a* includes a generally L-shaped support bar 70 that is adjustably and removably attached to the arm members 38. A lower portion of the each of the support bars 70 extends below and substantially perpendicular to the arms 38 while an upper portion of the support bar extends substantially parallel to the arms 38 but is spaced vertically above the arms 38. Preferably, the support bar 70 is attached to the arm member 38 by a clamp 72 that is actuated by a handwheel 76. The handwheel 76 actuates and releases the clamp 72 to allow the clamp 72 to be moved and located along the length of the arm 38 or to be completely removed from the arm 38.

A spring-biased release button 74 on an outer portion of the clamp 72 includes a rod (not shown) extending therefrom that cooperates with a plurality of bores (not shown) extending through or indentations (not shown) formed in the lower portion of the support bar 70, which allows for vertical adjustment of the support bar 70. A handwheel 78 attaches a clamping assembly 80 on the upper portion of the support bar 70. The clamping assembly 80 includes the forearm pad and assembly 40*a* attached thereto. The handwheel 78 allows for longitudinal adjustment of the forearm pad and assembly 40*a* along the upper portion of the support bar 70 and for 360° rotation of the forearm pad and assembly 40*a*. A handwheel 82 includes a rod (not shown) extending therefrom that cooperates with a plurality of bores (not shown) extending through or indentations (not shown) formed in a portion of a handgrip assembly 84 received by an open end of the clamping assembly 80. The handwheel 82 allows for length adjustment of the handle assembly 84 with respect to the open end of the clamping assembly 80.

The adaptive saddles 10 and 10' are extremely versatile and may be adapted to be used for a number of riders of varying handicaps or injuries while allowing the saddle body 12 to remain on a single horse (not shown). The adaptive saddle 10 or 10' may be advantageously customized in a great number of ways when determining the need and placement of the support assembly 24 or 24' on the saddle body 12 for each rider. For example, the adaptive saddle 10 or 10' can be used for a rider (not shown) who has minimal head and trunk control by attaching the support assembly 24 or 24' to the first attachment point 20 and attaching the trunk pad 32, the frame member 34, the arm members 38, the forearm pad 40 and the handgrip assembly 42 to the support member 26 or 26' best seen in FIG. 2.

The adaptive saddle 10 or 10' can also be used for a rider (not shown) who has obtained enough trunk control that the frame member 34, the arm members 38, and the forearm pads 40 or the forearm assemblies 40*a* may be removed while keeping the support member 26 or 26' the trunk pad 32, and the headrest 44 attached to the second attachment point 22 to provide support to the rider.

The adaptive saddle 10 or 10' can also be used for a rider who needs support for one arm only by removing one of the arm members 38 from the frame member 34. The adaptive saddle 10 or 10' can also be used for a rider who does not need head support by removing the headrest 44 from the adaptive saddle and support assembly. The adaptive saddle 10 or 10' may also be used for a rider who does not need forearm support by removing the forearm pads 40 or forearm assemblies 40*a* from the arms 38. If the rider needs only back support, the arms 38 may be removed and the trunk pad 32 and the headrest 44 or the trunk pad 32 only remain attached to the saddle body 12. The handgrip assemblies 42 and 84 could be adapted to be attached to the free ends of the arms 38 for those riders whose needs warrant only handgrip support.

Alternatively, an elbow pad (not shown) is attached to each of the arm members 38, for those riders who need less support than that provided by the forearm pads 40 or the forearm pad assemblies 40*a*. The elbow pads can include the handgrip assembly 42 or 84 adjustably and releasably attached thereto and extending outwardly therefrom.

The adaptive saddle 10 or 10' can also be used for a rider (not shown) who has obtained the strength to hold his or her head high and hold his or her trunk in a more upright position. This is done by attaching the support assembly 24 or 24' to the second attachment point 22 and attaching the trunk support pad 32, the frame member 34, the arm members 38, and the elbow pads to the support member 26 or 26'.

Those skilled in the art will realize that utilizing the same adaptive saddle 10 and 10' is advantageous to many riders and the adaptive saddle according to the present invention may also accommodate this by simply removing the entire support 24 or 24' from the saddle body 12 and placing a cap cover (not shown) over the first attachment point 20 and the second attachment point 22, best seen in FIG. 1. In this configuration, the saddle body 12 may be used as a standard saddle without requiring any portion of the support assembly 24 and 24' to be attached to either of the attachment points 20 and 22.

The therapeutic benefits of horseback riding to those in the population who are handicapped, disabled or injured are well known. The adaptive saddle 10 and 10' and the support assembly 24 or 24' in accordance with the present invention provide a means for providing a number of riders of varying disabilities the ability to ride a horse and take advantage of these known therapeutic benefits. Prior to the use of the adaptive saddle 10 and 10' each rider is evaluated to determine the need and placement of the support assembly 24 or 24' on the saddle body 12 in order to configure the assembly that provides the best overall support in order to promote the rider's independence.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An adaptive saddle for use on a horse with handicapped, disabled, and injured riders, comprising:

a saddle body having a pommel and a cantle, a front attachment point mounted to said saddle body adjacent said pommel, and a rear attachment point mounted to said saddle body adjacent said cantle; and a support assembly including a vertically extending support member adapted to be selectively and releasably attached to each of said front and rear attachment points and a trunk pad mounted on and selectively moveable along said support member, said support assembly providing support to a handicapped, disabled, or injured rider from behind when attached to said rear attachment point and from in front when attached to said front attachment point.

2. The adaptive saddle according to claim 1 including a headrest mounted on and selectively moveable along said support member.

3. The adaptive saddle according to claim 1 including a pair of handgrip assemblies removably attached to said support member and selectively moveable transverse to said support member.

4. The adaptive saddle according to claim 1 including a transverse frame member removably mounted on and selectively moveable along said support member and a pair of arm members each removably and adjustably attached to said frame member.

5. The adaptive saddle according to claim 4 including a pair of forearm pads, each said forearm pad being removably attached to an associated one of said arm members.

6. The adaptive saddle according to claim 5 including a pair of handgrip assemblies each removably and adjustably attached to an associated one of said forearm pads.

7. The adaptive saddle according to claim 4 wherein each of said forearm pads is at least one of moveable along and rotatable about said associated arm member.

8. The adaptive saddle according to claim 4 including a pair of handgrip assemblies each removably and adjustably attached to an associated one of said arm members.

9. An adaptive saddle for use on a horse with handicapped, disabled, and injured riders, comprising:

a saddle body having a pommel and a cantle, a front attachment point mounted to said saddle body adjacent said pommel, and a rear attachment point mounted to said saddle body adjacent said cantle;

a support assembly including a vertically extending support member adapted to be selectively and releasably attached to each of said front and rear attachment points and a trunk pad mounted on and selectively moveable along said support member, said support assembly providing support to a handicapped, disabled, or injured rider from behind when attached to said rear attachment point and from in front when attached to said front attachment point;

at least one arm member removably attached to said support member and adjustable along said support member; and a forearm pad removably attached to said at least one arm member and moveable along said at least one arm member.

10. The adaptive saddle according to claim 9 including a handgrip assembly removably attached to said forearm pad and moveable relative to said forearm pad.

11. The adaptive saddle according to claim 9 including a headrest mounted on and selectively moveable along said support member.

12. The adaptive saddle according to claim 9 including a transverse frame member removably mounted on and selectively moveable along said support member, said at least one arm member being removably and adjustably attached to said frame member.

13. An adaptive saddle for use on a horse with handicapped, disabled, and injured riders, comprising:

a saddle body having a pommel and a cantle, a front attachment point mounted to said saddle body adjacent said pommel, and a rear attachment point mounted in said saddle body adjacent said cantle;

a support assembly including a vertically extending support member adapted to be selectively and releasably attached to each of said front and rear attachment points, said support assembly providing support to a handicapped, disabled, or injured rider from behind when attached to said rear attachment point and from in front when attached to said front attachment point;

a trunk pad mounted on and selectively moveable along said support member;

a headrest mounted on and selectively moveable along said support member;

a transverse frame member removably mounted on and selectively moveable along said support member;

a pair of arm members each removably and adjustably attached to said frame member;

a pair of forearm pads, each said forearm pad being removably attached to an associated one of said arm members; and a pair of handgrip assemblies each removably and adjustably attached to an associated one of said forearm pads and said arm members.

* * * * *